US005785602A

United States Patent [19]

Morabito

[11] Patent Number: 5,785,602

[45] Date of Patent: Jul. 28, 1998

[54] CUE PUTTER

[75] Inventor: Christopher J. Morabito, 79 S. Regent St., Port Chester, N.Y. 10573

[73] Assignee: Christopher J. Morabito, Cortlandt Manor, N.Y.

[21] Appl. No.: 729,877

[22] Filed: Oct. 15, 1996

[51] Int. Cl.[6] ..... A63B 53/08; A63B 53/10

[52] U.S. Cl. ..... 473/2; 473/3; 473/42; 473/51; 473/313; 473/314; 473/340

[58] Field of Search ..... 473/1, 2, 3, 42–49, 473/51, 313, 314, 340

[56] References Cited

U.S. PATENT DOCUMENTS

| | | | |
|---|---|---|---|
| 3,220,730 | 11/1965 | Fine | 473/49 |
| 3,445,112 | 5/1969 | Fritz | 473/44 |
| 3,534,959 | 10/1970 | Elswick | 473/2 |
| 3,591,176 | 7/1971 | Roth | 473/3 |
| 3,873,094 | 3/1975 | Sebo | 473/340 |
| 5,290,030 | 3/1994 | Medbury | 473/47 |

FOREIGN PATENT DOCUMENTS 2 239 400 3/1991 United Kingdom .

*Primary Examiner*—Sebastiano Passaniti
*Assistant Examiner*—Stephen L. Blau

[57] ABSTRACT

The Cue Putter is unique golf club, far superior in design to existing putters. It is designed to maximize a golfer's putting accuracy and consistency. The Cue Putter consists of a wooden club shaft, a guide block, rubber "O"-rings, and a transparent Plexiglas clubhead. The Cue Putter is designed to be used while kneeling on the green, with the putter's shaft aligned and used parallel to the putting surface. The Cue-Putter is gripped with one hand, and the stroke is executed primarily with the fingers and wrist instead of the arms and shoulders used with traditional putters. This improves the golfer's putting "touch" tremendously, because the innate precision of the hand and fingers cannot be matched by the larger muscle groups of the arms and shoulders. The Cue Putter also provides an ideal, "real time" view of the slope and undulation of the green, instead of a vague, "mental snapshot" taken while the golfer crouches down yards behind the ball prior to assuming his stance. This improved view significantly enhances the golfer's ability to gauge distance, while allowing the golfer to focus primarily on the target (cup) instead of the golf ball. In addition, the unique transparent clubface allows for a simultaneous view of the ball and the target (cup). The Cue Putter is also more reliable than a traditional "right-angle" putter, which incorporate a pendulum arc swing. The pendulum swing is difficult to replicate precisely from putt to putt. The Cue Putter incorporates a straight, forward stroke which can be precisely measured visually and replicated.

1 Claim, 1 Drawing Sheet

CUE PUTTER

CROSS-REFERENCE

None.

MICROFICHE REFERENCE

None.

BACKGROUND OF THE INVENTION

1. Technical Field

The field of this invention pertains to the sport of golf, with the primary applicable U.S. Patent Classification being Class D21 "Games, Toys, & Sporting Goods" and the secondary classification being Class 273 "Amusement Devices". This invention is a new type of golf putter.

2. Prior Art

A search of existing patents in this field reveals at least sixteen existing patents of various types of golf putters. All of these patents involve a traditional style perpendicular-shaft putter or slight modification thereof. These putters generally consist of a metal or composite shaft connected on a right-angle to a metal clubhead, and are designed to be used perpendicular to the putting surface while standing astride the ball.

The architect's axiom "Form Follows Function" has largely been ignored with the prior art. Traditional putters are poorly designed for such an exacting, fine-motor task like putting. This invention eliminates the following problems with the prior art:

1). Bio-mechanical Inefficiency

To use a traditional putter, the golfer grips the club, locks his wrists, and executes the stroke primarily with his arms and shoulders. The large muscle groups of the shoulders and arms are not bio-mechanically suited for such a precise, fine-motor task like putting. This invention taps the innate precision of the human fingers, hand, and wrist, while eliminating the use of the shoulders and most of the arm muscles. By using the hand and wrist, the golfer's "feel" or "touch" is significantly enhanced, and his putting dramatically improves with the Cue Putter.

A second bio-mechanical deficiency of existing putters concerns the "pendulum" swing used to execute the stroke. Traditional putters are all designed to grip the shaft near the top and swing the club in a small pendulum-type arc, with the pivot point generally in the vicinity of the hands. The longer the putt, the higher the path of the arc from back-swing to follow-through. This pendulum arc is difficult to gauge from putt to putt, hampering the golfer's ability to replicate the proper force to propel the ball the exact distance to the cup. The Cue Putter eliminates the inefficient pendulum arc, replacing it with an efficient, straight forward stroke to propel the ball. This stroke can be visually recalled easily by the golfer, due to the Cue Putter's distance mark bands along the shaft, enabling him to replicate the proper amount of force from putt to putt.

2). Compromised View of the Green

To putt accurately, a golfer must become proficient at "reading the green"; that is, the degree of slope and undulation of the putting surface between the ball and the cup. To "read the green", golfers usually crouch down low behind the ball to view the green, since it is not possible to ascertain the slope from a standing position. Taking a "mental snapshot" of this view, they rise, walk over and address the ball, and putt with this mental picture of the green in mind. Essentially, the golfer relies on his recollection of this mental picture in aligning his putt. This is a very unreliable method of "reading the green". With the Cue Putter it isn't necessary to rely on a mental picture of the green, because it allows a "real time" view of the green during the stroke. The golfer is down low, close to the green, where he can enjoy the best view of the green before, during, and after the stroke. In addition to the dramatic improvement in his putting, the golfer will receive more direct, visual feedback on those occasions when he misses a putt, because he observes how the ball rolls in relation to each section of the green from his low vantage point.

3). Poor view of the Target

With a traditional putter, the golfer executes the putt while standing astride the ball, with his head down and his eyes fixed on the ball. The target (cup) is, except for very short putts, only in the peripheral view during the stroke. With the Cue Putter, the golfer focuses on the target (cup), not the ball, which significantly improves accuracy. Due to the Cue Putter's unique transparent clubhead, the ball is also in view during the stroke. When a golfer uses a traditional putter, the position of his head and eyes are aligned in an awkward perpendicular position which is certainly less than ideal to gauge distance. The Cue Putter affords the golfer a natural, horizontal view of the cup, taking maximum advantage of the stereoscopic ability of the eyes, which is the primary means by which humans judge distance.

SUMMARY OF THE INVENTION

The invention is named the Cue Putter. The Cue Putter consists of a 32" wooden shaft, a wooden guide block, rubber O-rings, and a transparent Plexiglas clubhead. The object of the invention is to maximize a golfer's putting accuracy and consistency.

The Cue Putter is designed to be used while kneeling on the green with the club shaft aligned and used parallel to the putting surface. The Cue Putter is designed to take maximum advantage of the fine-motor capabilities of the golfer's hand and fingers, the stereoscopic ability of his eyes, the efficiency of a straight, forward stroke, and the ideal view of the green & cup.

Traditional putters are poorly designed to achieve the precision needed to putt a golf ball. A typical putter is 35–37" long, consisting of an aluminum or composite shaft connected on a right angle to a composite clubhead. In using the traditional putter, the golfer grips the club, locks his wrists, and executes the stroke primarily with his arms and shoulders. The large muscle groups of the shoulders and arms are clearly not biomechanically suited for such a precise, fine-motor task like putting. The Cue Putter capitalizes upon the innate precision of the fingers, hand, and wrist, while eliminating the use of the shoulder and most of the arm muscles. The Cue Putter provides the golfer with an incredible "feel" or "touch" which simply cannot be achieved with a traditional putter employing an arm/shoulder putting style. The Cue Putter's shaft is aligned and used parallel to the green while kneeling, which gives the golfer a "real time" view of the slope/undulation of the green. In addition, the low, horizontal angle of the eyes maximizes their stereoscopic ability at the precise moment the ball is struck, aiding the golfer's ability to gauge distance. Finally, the target (cup) is in the center of the vision field and in constant view, and not merely in the golfer's peripheral vision field. Due to the Cue Putter's unique transparent Plexiglas clubhead, the ball and cup are simultaneously in view throughout the stroke, which is not possible with traditional putters.

The Cue Putter's physical dimensions, composition, and method of use, prima facie, do not violate Rule 4-1 "Form and Make of Clubs" or Appendix II "Design of Clubs" as described in the United States Golf Association's 1996 Rules of Golf. However, Rule 4 does state that a sample of a new club which is to be manufactured should be submitted to the USGA for an official ruling as to whether the club conforms to the rules. Upon the issuance of a U.S. Patent, the prototype of the Cue Putter will be forwarded to the USGA for examination.

DETAILED DESCRIPTION OF THE INVENTION

Figure 1:
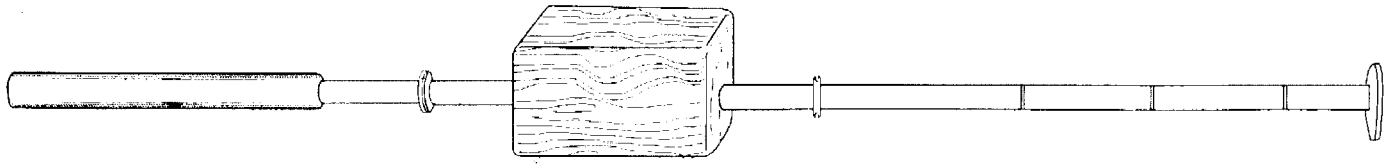
FIG. 1 depicts an elevated side view of the Cue Putter.
Figure 2:
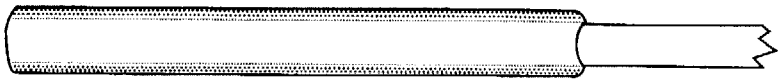
FIG. 2 depicts a side view of the tapered rubber grip of the shaft.
Figure 3:
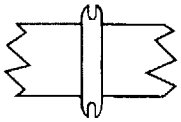
FIG. 3 depicts a side view of one of the two identical sliding rubber "O" rings on the club shaft.
Figure 4:
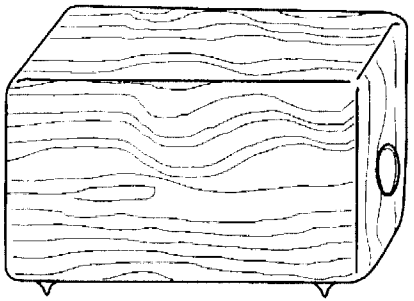
FIG. 4 depicts an elevated side view of the wooden rectangular guide block and cleats.
Figure 5:
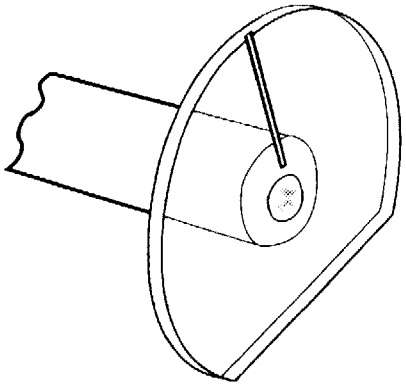
FIG. 5 depicts an elevated front/side view of the semi-circular transparent Plexiglas clubhead with a sight line on the face.

The Cue Putter is designed to be aligned and used parallel to the putting surface (green) while the golfer kneels on a foam cushion. The wooden club shaft slides freely through a guide block, striking the golf ball and propelling it toward the cup (hole). The Cue Putter consists of the following components which are depicted on the two drawing pages.

Cue Putter's wooden shaft, measuring 32" in length and ⅝" in diameter;

Rubber hand grip, measuring 7" in length with a semi-circular tapered diameter;

(2) sliding rubber "O"-rings, measuring 1.5" in outside diameter;

Wooden rectangular guide block, measuring 5"×3.5"×3", with a 0.69" shaft hole and four cleats;

Semi-circular transparent Plexiglas clubhead, measuring 2.25"×0.12"×1.63".

To prepare to execute a putt with the Cue Putter, the golfer performs the following five-step sequence:

1. Golfer places the kneeling cushion approximately two feet behind and to the left or right of the ball (depending upon his dominant hand) and kneels on the cushion;
2. Golfer adjusts the club shaft to the "putt alignment stripe", located 17" from the clubhead, and places the entire putter down on the green so that the clubhead is 1" behind the ball;
3. Golfer carefully "reads the green" from his kneeling position; that is, he views whatever slope, undulation, and grass conditions exist between his ball and the cup. He then slightly adjusts the Cue Putter's position to the left or right, to create the appropriate "putting line" for the specific conditions he perceives;
4. Golfer slides the front "O"-ring to the proper position, based upon the golfer's estimate of force needed to propel the ball to the cup;
5. Gripping the rubber grip with his dominant hand, the golfer slides the club shaft away from the ball until the front "O"-ring contacts the front of the guide block, acting as a "stop". The golfer then strokes the club shaft forward, striking the ball and propelling it forward to roll across the green and into the cup.

The Cue Putter represents a vast improvement over existing putters, incorporating the following features/enhancements which are fully detailed in Section D(2) "Description of Prior Art":

Significantly improves the golfer's "feel" or "touch" by eliminating the use of shoulder/arm muscles.

Enables golfer to have a "real time" ideal view of the slope/undulation of the green during the stroke.

Provides the golfer with a horizontal stereoscopic view of the cup during the stroke, while the transparent clubhead provides a simultaneous view of the ball.

Provides a visual mark on the club shaft, enabling the golfer to precisely gauge and consistently replicate the precise force needed to execute the putt.

Eliminates the inconsistent pendulum-type stroke used with existing putters.

I claim:

1. A golf putter used parallel to the putting green surface consisting of a wooden guide block, an elongated shaft, adjustable rubber "O" rings on the shaft, and a transparent clubface whereby:

the rubber adjustable "O" rings are slidable along the wooden club shaft to precisely indicate the amount of force necessary for each putt;

the wooden guide block is placeable on a green and has a hole substantially parallel to the ground in which the shaft can slide freely through and strike a ball; and the transparent clubface can be viewed through and has a sight line on the face for aligning the putter.

* * * * *